US007900445B2

(12) United States Patent
Brockmann

(10) Patent No.: US 7,900,445 B2
(45) Date of Patent: Mar. 8, 2011

(54) HYDRAULIC SUPPLY SYSTEMS

(75) Inventor: Andreas Brockmann, Bidingen (DE)

(73) Assignee: AGCO GmbH (DE)

( * ) Notice: Subject to any disclaimer, the term of this patent is extended or adjusted under 35 U.S.C. 154(b) by 1002 days.

(21) Appl. No.: 11/697,900

(22) Filed: Apr. 9, 2007

(65) Prior Publication Data

US 2007/0235078 A1 Oct. 11, 2007

(30) Foreign Application Priority Data

Apr. 7, 2006 (GB) ..... 0606997.5

(51) Int. Cl.
*F15B 11/16* (2006.01)
*E02F 9/22* (2006.01)

(52) U.S. Cl. ..... 60/422; 60/433

(58) Field of Classification Search ..... 60/422, 60/433, 452, 484
See application file for complete search history.

(56) References Cited

U.S. PATENT DOCUMENTS 5,562,019 A * 10/1996 Kropp ..... 60/422
6,134,887 A * 10/2000 Bertotti ..... 60/422
6,220,027 B1 * 4/2001 Heusser ..... 60/422
6,644,025 B1 * 11/2003 Oberhausser et al. ..... 60/422
6,931,847 B1 * 8/2005 Throckmorton et al. ..... 60/422

* cited by examiner

*Primary Examiner*—Thomas E Lazo
(74) *Attorney, Agent, or Firm*—Ryan A. Schneider, Esq.; Troutman Sanders, LLP

(57) ABSTRACT

Disclosed is a hydraulic system for supplying primary and auxiliary pressure medium consumers with different system pressures, which exceed the load pressure by a pre-determined control pressure differential. Primary load pressure is used to produce a first control pressure differential for operating a primary pressure medium consumer. Auxiliary load pressure is converted in an amplifying device to produce a second, higher control pressure differential for operating an auxiliary pressure medium consumer. The amplifying device consists of a pressure reducing valve, which is permanently adjusted to a pre-determined reduced pressure and has a line conducting the system pressure connected to a first pressure inlet, a load reporting line conducting the load pressure of the auxiliary pressure medium consumer connected to a second inlet and a load reporting line subjecting the pressure control valve to increased load pressure connected to an outlet and the control piston is subjected on its one side to the force of a permanently adjusted spring.

3 Claims, 1 Drawing Sheet

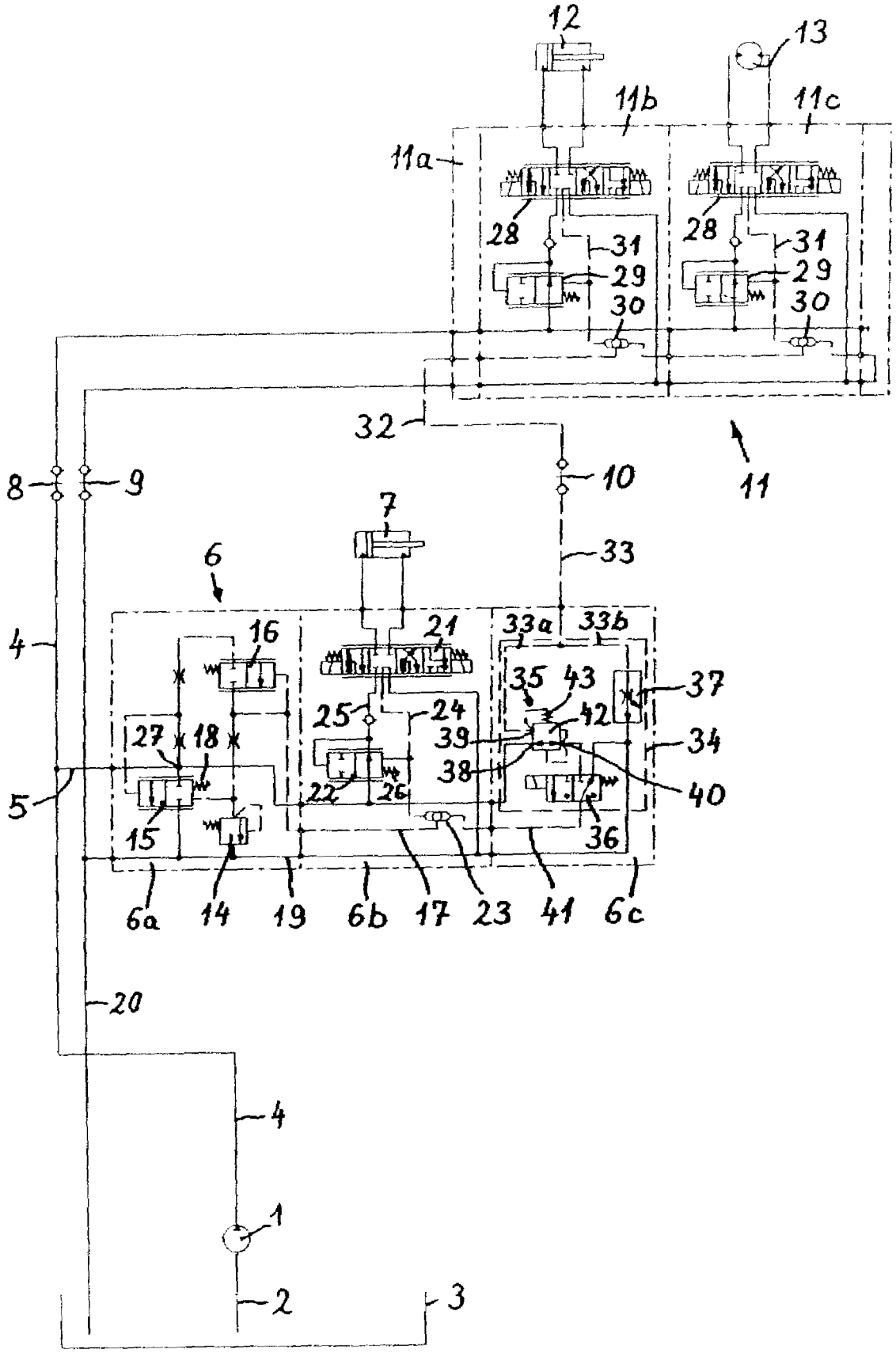
12
13
11b
11c
11a
28
28
31
31
29
29
30
30
32
11
8
9
10
7
33
6
4
16
21
33a
33b
35
43
37
25
24
42
27
18
39
34
38
40
5
22
26
15
36
6a
14
19
6b
17
23
41
6c
20
4
1
2
3

HYDRAULIC SUPPLY SYSTEMS

BENEFIT CLAIM

This application is based on, and claims the benefit of priority to, UK application GB 0606997.5, filed 7 Apr. 2006, which priority application is hereby incorporated by reference.

BACKGROUND OF THE INVENTION

1. Field of the Invention

The invention relates to a system for utility vehicles, in particular agricultural tractors, for supplying primary and auxiliary pressure medium consumers with different system pressures, which are built up as a function of the load pressure of the pressure medium consumers and which exceed the load pressure by a pre-determined control pressure differential. In order to produce a first control pressure differential for operating a primary pressure medium consumer, its load pressure is used directly for building up the system pressure and in order to produce a second, higher control pressure differential for operating an auxiliary pressure medium consumer, its load pressure is converted in an amplifying device to an increased pressure, which is used for building up a higher system pressure.

2. Description of Related Art

European Patent EP 10 70 852 A2 describes a hydraulic system, which can be equipped with a load sensing pump or a fixed displacement pump and whose system pressure and flow rate are adapted to the respective need by a pressure and flow controller. If a fixed displacement pump is used the pressure and flow controller is adjusted as a function of the maximum load pressure of the primary pressure medium consumers so that the system pressure is always higher by a pressure differential of approximately 10 bar than the maximum load pressure. For operating auxiliary pressure medium consumers due to the greater pressure losses in the supply lines the pressure and flow controller is adjusted in such a way that the system pressure is always higher by a pressure differential of approximately 20-23 bar than the maximum load pressure. To create the higher control pressure differential for auxiliary pressure medium consumers an amplifying device is provided, which produces an actuating pressure exceeding the maximum load pressure, to which the pressure and flow controller is subjected. To this end for operating both the primary and auxiliary pressure medium consumers the actuating pressure between two throttling restrictions of the amplifying device is reduced. To create different actuating pressures, as they are needed to produce the various control pressure differentials for these pressure medium consumers, the line containing the throttling restrictions is blocked by means of an additional pressure regulator whenever a primary pressure medium consumer is in operation and unblocked whenever an auxiliary pressure medium consumer is in operation. A disadvantage here is that the load pressure of the primary pressure medium consumers, which is utilized as actuating pressure for operating said pressure medium consumers is subject to restriction when passing through the throttling restrictions. As a result the actuating pressure takes longer to build up and finally the system dynamics are lower as a result.

A further disadvantage of the prior art hydraulic system is apparent if no implement is mounted on the vehicle, that is to say no auxiliary pressure medium consumer is connected to the hydraulic system of the vehicle. In this case it is possible that due to thermal expansion of the pressure medium inside the load pressure line of the auxiliary pressure medium consumers, which conducts the load pressure, or due to a leakage, pressure medium undesirably flows to the pressure and flow controller of the pump. The effect of this is automatic restriction of the pump even as far as actuation of the assigned pressure relief valve (pump short-circuit).

Hydraulic systems of the type described are predominantly used in high performance agricultural tractors because of the high cost of the load-sensing pump. In less powerful agricultural tractors hydraulic systems with cost-favourable fixed displacement gear pumps as well as load sensing control valves are normally used. A pressure regulator is assigned to such a pump, which in the case of non-operating pressure medium consumers and a control pressure differential of approximately 5 bar returns the conveyed pressure medium to the tank virtually unpressurized. On the other hand if at least one pressure medium consumer is in operation, a system pressure, which is higher by a control pressure differential of approximately 13 bar than its load pressure is built up as a function of the load pressure. Therefore all primary pressure medium consumers mounted on the vehicle can be adequately supplied with pressure medium. As is the case of the prior art hydraulic system however this does not apply to auxiliary pressure medium consumers, in the long supply lines of which substantial pressure losses take place.

It is therefore desirable to provide a hydraulic system of the kind described at the beginning, which, irrespective of whether the hydraulic system is equipped with a variable displacement (load sensing) pump or fixed displacement (gear) pump, can supply sufficient volume and pressure to both the primary pressure medium consumers and the auxiliary consumers without any significant time delay.

BRIEF SUMMARY OF THE INVENTION

This objective is achieved by the fact that the amplifying device consists of a pressure reducing valve, which is permanently set at a pre-determined reduced pressure and has a first pressure inlet, a second inlet, an outlet and a control piston, whereby a line conducting the system pressure is connected to the first pressure inlet, a load reporting line conducting the load pressure of the auxiliary pressure medium consumer is connected to the second inlet and a load reporting line conducting the increased load pressure is connected to the outlet, and the control piston on its one side is subjected to the force of a permanently adjusted spring, which determines the pre-determined reduced pressure as well as the load pressure prevailing at the second inlet of the auxiliary pressure medium consumer and on its other side to the pressure at the outlet.

This arrangement in the case of hydraulic systems with the most varied system pressure sources enables the cost of the amplifying device to be minimized by using only one economical standard component and the auxiliary load pressure to be superimposed with a permanently pre-determined pressure. So that this permanently pre-determined pressure, when no auxiliary pressure medium consumer is in operation, cannot have any undesirable effects on the pressure controller of the pump, a solenoid-operated switching valve can be arranged in the line, which is switched to the passage position whenever auxiliary pressure medium consumers are in operation.

The load reporting line conduction the load pressure of the auxiliary pressure medium consumers is connected via a flow control valve to the tank. This reliably prevents pressure from building up in the amplifying device due for example to thermal expansion of the pressure medium, which may affect the build up of the required system pressure in an undesirable way.

BRIEF DESCRIPTION OF DRAWING

The invention is described below in detail with reference to the accompanying drawing showing a circuit diagram for a hydraulic system in accordance with the invention.

DETAILED DESCRIPTION OF PREFERRED EMBODIMENTS

The circuit diagram shows a hydraulic system of an agricultural tractor having a fixed displacement pump 1, which sucks pressure medium via a suction pipe 2 from a tank 3 and supplies this medium via pressure pipes 4, 5 to a tractor-mounted control block 6. From here the pressure medium is distributed to primary pressure medium consumers 7, directly connected to the hydraulic system. By means of an auxiliary control block 11, connected via hydraulic couplings 8, 9, 10 to the hydraulic system of the tractor, further distribution to auxiliary pressure medium consumers 12, 13 is realized. "Pressure medium consumers" here are understood as single and double acting hydraulic actuators (linear actuators and rotating actuators) for driving different implements such as for example the primary power take off cylinder of the implement attachment device or the auxiliary hydraulic motors for the undercarriage and the blower of a sowing machine for example.

The primary control block 6 consists of an inlet section 6*a*, a valve section 6*b* and a sealing plate 6*c*, which are bolted together to form a unit. Several valve sections 6*b* can be provided, depending on the number of pressure medium consumers 7 to be actuated.

The inlet section 6*a* houses a pressure relief valve 14, a pressure regulator 15 and a pressure sequence valve 16, whose common task consists in keeping the system pressure of the hydraulic system at a level, at which on the one hand as low as possible power losses arise for example in neutral circulation, that is to say if no pressure medium consumer is in operation, and on the other hand each actuated pressure medium consumer is operated at optimum pressure. Such arrangements have been known for a long time and have been described in detail.

The pressure relief valve 14 limits the system pressure to a maximum permissible value. Customary values for agricultural tractors are 200 bar. The pressure scale 15 as a function of the load pressure of the operating pressure medium consumers 7 communicated via a load reporting line 17 is adjusted so that a defined pressure gradient, also called control pressure differential, always prevails between the pressure pipe 5 and the load reporting line 17. If no pressure medium consumer is actuated and therefore no load pressure prevails, the pressure regulator 15 switches to neutral circulation. For this purpose the pressure regulator 15 is pre-tensioned by means of a spring 18 to a pressure of approximately 5 bar, so that pressure medium conveyed from the pump 1 flows back virtually unpressurized and with low losses to the tank 3 via the return pipes 19, 20. If the load reporting line 17 is unpressurized, the pressure sequence valve 16 is in the blocked position. If a pressure>10 bar prevails in the load reporting line 17, the pressure sequence valve 16 changes to the passage position. In this case a control pressure differential of 13 bar arises at the pressure regulator 15.

The valve section 6*b* contains a solenoid-operated main slide valve 21 of the load sensing type, a section pressure regulator 22 and a shuttle valve 23. The primary pressure medium consumer 7 is connected to the main slide valve 21. Its pressure medium is supplied via the pressure pipe 5 and its load pressure is supplied to the pressure regulator 15 via load reporting line 24, shuttle valve 23 and load reporting line 17. The section pressure regulator 22 lies in a pressure pipe 25 branching off from the pressure pipe 5 to the main slide valve 21 and by corresponding pre-tensioning of a spring 26 permits a desired differential pressure to be adjusted between the pressure pipe 25 and the load reporting line 24. A customary value for the pressure differential is approximately 8 bar.

For normal operation of primary pressure medium consumers 7 a differential pressure of approximately 13 bar is necessary. The pressure regulator 15 builds up this differential pressure, as the result of the previously closed pressure sequence valve 16 being switched to the passage position by means of the maximum load pressure of the actuated primary pressure medium consumers 7 via the load reporting lines 24, 17. Thus a differential pressure of approximately 13 bar arises between the load pressure pipe 17 and the junction 27, which is sufficient to compensate for any flow losses between the pump 1 and the valve section 6*b*. Such adjustment of the pressure gradient ensures low-loss and reliable operation of the primary pressure medium consumers 7.

The auxiliary control block 11 is arranged on an implement, a potato digger for example, and consists of an inlet section 11*a* and several valve sections 11*b*, whereby a valve section 11*b* is present and a sealing plate 11*c* for each pressure medium consumer 12,13 operated with the implement. The auxiliary valve section 11*b* has a solenoid-operated main slide valve 28 of the load sensing type, a section pressure regulator 29 and a shuttle valve 30 corresponds in structure and working method to that of a primary valve section 6*b*. Load reporting lines 31 leading from the main slide valve 28 conduct the load pressure of the auxiliary pressure medium consumers 12, 13 to the shuttle valve 30. From these the respective maximum load pressure is transmitted to the auxiliary load reporting line 32, which leads to the hydraulic coupling 10. From here a primary load reporting line 33 conducts the load pressure to an amplifying device 34 integrated in the sealing plate 6*c*.

The amplifying device 34 consists of a mechanical pressure reducing valve 35 permanently set to 10 bar, solenoid-operated switching valve 36 and a flow control valve 37 set to a nominal flow rate of approximately 0.5 liters per minute. In the embodiment described the pressure reducing valve 35 is arranged in such a way that its pressure inlet 38 is connected to the pressure pipe 5, the inlet 39 to the load reporting line 33*a* branching off from the load reporting line 33 and the outlet 40 is connected to a load reporting line 41. The switching valve 36 is arranged in the load reporting line 41. It is only switched to the passage position when auxiliary pressure medium consumers 12, 13 are in operation, so that the load pressure applied to the outlet 40 can be conducted to the pressure regulator 15 via the shuttle valve 23 and the load reporting line 17. If no auxiliary pressure medium consumer is actuated, the switching valve 36 is switched to its closed position. The load reporting line 41 is then connected to the return pipe 19 by the switching valve 36 and thus safely vented. Therefore any undesirable influence of the pressure regulator 15 is ruled out with certainty.

The control piston 42 of the pressure reducing valve 35 is in a state of equilibrium, whereby the permanently set force of a spring 43 as well as the load pressure at the inlet 39 act upon one side of the control piston 42 and the return pressure at the outlet 40 acts upon the other side of the control piston 42.

Typically such pressure reducing valves are used to reduce the pressure at the pressure inlet 38 to a permanently pre-determined value and to make the reduced pressure available at the outlet 40. Differently than proposed in the present embodiment therefore with conventional arrangement of the pressure reducing valve 35 the connection actually used as inlet 39 for the load pressure of the auxiliary pressure medium consumers 12, 13 represents a tank inlet, while the pressure at the outlet 40 is used to actuate further valves.

The flow control valve 37 lies in a branch line 33*b* of the load reporting line 33, which communicates with the return pipe 19. As a result it is guaranteed that if attachments are not in use no unintentional load pressure reporting occurs through thermally-related pressure increase in the load reporting line 33.

The load pressure of the control block 11 according to the circuit diagram lies on the inlet 39 of the pressure reducing valve 35. If no auxiliary pressure medium consumer 12, 13 is in operation, a pressure of 10 bar prevails at the outlet 40 depending on the permanent setting of the pressure reducing valve 35. So that this constant pressure does not lead to inadvertent reaction of the pressure regulator 15, the switching valve 36 is switched to its position blocking the load reporting line 41.

As soon as an auxiliary pressure medium consumer 12, 13 is put into operation, the switching valve 36 is switched to its position unblocking the load reporting line 41. The load pressure lying on the inlet 39 is looped in the ratio 1:1 through the pressure reducing valve 35 to the outlet 40 and is superimposed onto the always present permanently set differential pressure of 10 bar. The load pressure increased by the differential pressure is now communicated via the load reporting lines 41 and 17 to the pressure regulator 15, which as a result of the increased load pressure is induced to further raise the system pressure of the apparatus compared to the operation of primary pressure medium consumers 6, which guarantees trouble-free operation of the auxiliary pressure medium consumers 12, 13.

The invention has been described by the example of a hydraulic system with a fixed displacement pump. If the invention is to be used with a hydraulic system with a variable displacement pump, then the load reporting line 17 has only to be connected to the corresponding load inlet of the pressure and flow controller of the pump. Since such pressure and flow controllers are generally known in structure and working method, these are not described in greater detail.

I claim:

1. Hydraulic system for utility vehicles, in particular agricultural tractors, for supplying primary and auxiliary pressure medium consumers with different system pressures, which are built up as a function of the load pressure of the pressure medium consumers and which exceed the load pressure by a pre-determined control pressure differential whereby, in order to produce a first control pressure differential for operating a primary pressure medium consumer, its load pressure is used directly for building up the system pressure and in order to produce a second, higher control pressure differential for operating an auxiliary pressure medium consumer, its load pressure is converted in an amplifying device (34) to an increased pressure, which is used for building up a higher system pressure, the amplifying device having of a pressure reducing valve, which is permanently adjusted to a pre-determined reduced pressure and has a first pressure inlet, a second inlet, an outlet and a control piston, whereby a line conducting the system pressure is connected to the first pressure inlet, a load reporting line conducting the load pressure of the auxiliary pressure medium consumer is connected to the second inlet and a load reporting line conducting the increased load pressure is connected to the outlet, and the control piston is subjected on its one side to the force of a permanently adjusted spring, which determines the pre-determined reduced pressure as well as the load pressure of the auxiliary pressure medium consumer prevailing at the second inlet, and on its other side to the pressure at the outlet.

2. Hydraulic system according to claim 1, in which a solenoid-operated switching valve is arranged in the load reporting line, which is switched to the passage position when auxiliary pressure medium consumers are in operation.

3. Hydraulic system according to claim 1, in which the load reporting line conducting the load pressure of the auxiliary pressure medium consumers is connected via a flow control valve to the tank.

* * * * *